US011326619B2

(12) United States Patent
Rusch et al.

(10) Patent No.: US 11,326,619 B2
(45) Date of Patent: May 10, 2022

(54) DIFFUSER FOR A RADIAL COMPRESSOR

(71) Applicant: ABB Schweiz AG, Baden (CH)

(72) Inventors: Daniel Bernhard Rusch, Wettingen (CH); Rene Hunziker, Villigen (CH)

(73) Assignee: ABB SCHWEIZ AG, Baden (CH)

( * ) Notice: Subject to any disclaimer, the term of this patent is extended or adjusted under 35 U.S.C. 154(b) by 79 days.

(21) Appl. No.: 16/639,674

(22) PCT Filed: Aug. 16, 2018

(86) PCT No.: PCT/EP2018/072247
§ 371 (c)(1),
(2) Date: Feb. 17, 2020

(87) PCT Pub. No.: WO2019/034740
PCT Pub. Date: Feb. 21, 2019

(65) Prior Publication Data

US 2020/0173462 A1 Jun. 4, 2020

(30) Foreign Application Priority Data

Aug. 18, 2017 (DE) ..... 102017118950.5

(51) Int. Cl.
*F04D 29/44* (2006.01)
*F04D 29/28* (2006.01)
(Continued)

(52) U.S. Cl.
CPC ..... *F04D 29/444* (2013.01); *F04D 29/284* (2013.01); *F04D 29/30* (2013.01);
(Continued)

(58) Field of Classification Search
None
See application file for complete search history.

(56) References Cited

U.S. PATENT DOCUMENTS 4,131,389 A 12/1978 Perrone et al.
4,815,935 A * 3/1989 Gottemoller ..... F04D 29/444 415/211.1
(Continued)

FOREIGN PATENT DOCUMENTS

CN 1461893 A 12/2003
CN 103534488 A 1/2014
(Continued)

OTHER PUBLICATIONS

First Office Action for related CN 201880053541.7, dated Nov. 24, 2020, with translation, 19 pages total.
(Continued)

*Primary Examiner* — Michael Lebentritt
(74) *Attorney, Agent, or Firm* — Armstrong Teasdale LLP

(57) ABSTRACT

The invention relates to a diffuser for a radial compressor, comprising a flow channel defined by a first side wall and a second side wall, a diffuser vane ring with a plurality of diffuser vanes that are at least partially arranged in the flow channel, each of the diffuser vanes having a pressure side and a suction side, a plurality of diffuser passages, said diffuser passages being formed between every two adjacent diffuser vanes of the plurality of diffuser vanes, and circulation openings, each circulation opening connecting the flow channel to a diffuser cavity, at least two circulation openings being associated with one diffuser passage, and a circulation opening associated with a diffuser passage being fluidically connected to another circulation opening associated with the same diffuser passage or to a circulation opening associated with another diffuser passage, via the diffuser cavity.

23 Claims, 5 Drawing Sheets

(51) Int. Cl.
*F04D 29/30* (2006.01)
*F04D 29/68* (2006.01)

(52) U.S. Cl.
CPC ..... *F04D 29/684* (2013.01); *F05D 2220/40* (2013.01); *F05D 2240/121* (2013.01); *F05D 2250/51* (2013.01)

(56) References Cited

U.S. PATENT DOCUMENTS

| | | | | |
|---|---|---|---|---|
| 5,730,580 | A * | 3/1998 | Japikse | F01D 17/16 415/208.3 |
| 6,155,777 | A | 12/2000 | Aschenbruck et al. | |
| 6,200,094 | B1 | 3/2001 | Skoch et al. | |
| 6,669,436 | B2 | 12/2003 | Liu | |
| 7,736,126 | B2 | 6/2010 | Joco et al. | |
| 8,043,046 | B2 | 10/2011 | Guemmer | |
| 9,086,002 | B2 | 7/2015 | Konig | |
| 10,473,115 | B2 | 11/2019 | Kreienkamp et al. | |
| 2003/0161717 | A1 | 8/2003 | Liu | |
| 2005/0123394 | A1* | 6/2005 | McArdle | F04D 29/422 415/164 |
| 2005/0207885 | A1* | 9/2005 | Daudel | F04D 29/462 415/191 |
| 2009/0263233 | A1 | 10/2009 | Guemmer | |
| 2013/0156587 | A1* | 6/2013 | Kubel | F01D 5/005 416/219 R |
| 2013/0280060 | A1* | 10/2013 | Nasir | F04D 29/444 415/208.2 |
| 2014/0020975 | A1 | 1/2014 | Konig | |
| 2014/0105723 | A1 | 4/2014 | Porodo et al. | |
| 2015/0176600 | A1* | 6/2015 | Jenks | F01D 5/005 415/146 |
| 2017/0284401 | A1 | 10/2017 | Kreienkamp et al. | |
| 2018/0142701 | A1* | 5/2018 | Woehr | F04D 29/444 |
| 2018/0306203 | A1* | 10/2018 | Nasir | F02C 6/12 |

FOREIGN PATENT DOCUMENTS

| | | | |
|---|---|---|---|
| CN | 103635699 | A | 3/2014 |
| CN | 105443443 | A | 3/2016 |
| DE | 603 00 589 | T2 | 1/2006 |
| DE | 10 2008 044 505 | A1 | 3/2010 |
| DE | 10 2016 208 265 | A1 | 11/2017 |
| EP | 0 947 707 | A2 | 1/1999 |
| EP | 2 110 559 | A2 | 3/2009 |
| JP | 06076697 | U | 10/1994 |
| JP | 2009281155 | A | 12/2009 |
| JP | 2013119828 | A | 6/2013 |
| WO | 2012/116880 | A1 | 9/2012 |
| WO | 2016/102594 | A1 | 6/2016 |
| WO | 2016102594 | A1 | 6/2016 |

OTHER PUBLICATIONS

International Preliminary Report on Patentability for PCT/EP2018/072247 dated Feb. 18, 2020, with translation, 14 pages.
International Search Report for PCT/EP2018/072247 dated Oct. 29, 2018, with translation,7 pages.
Written Opinion for PCT/EP2018/072247 dated Oct. 29, 2018, with translation, 12 pages.
Search Report for DE 10 2017 118 950.5 dated May 25, 2018, with partial machine translation, 9 pages.

* cited by examiner

DIFFUSER FOR A RADIAL COMPRESSOR

CROSS-REFERENCE TO RELATED APPLICATIONS

This application is a national stage entry under 35 U.S.C. § 371 of PCT International Application No. PCT/EP2018/072247, filed Aug. 16, 2018, which claims priority to German Patent Application No. 10 2017 118 950.5, filed Aug. 18, 2017. The entire disclosures of the foregoing applications are incorporated herein by reference.

TECHNICAL FIELD OF THE INVENTION

The present invention relates to a diffuser for a radial compressor. The designation radial compressor below also comprises what are known as mixed-flow compressors with an axial inflow and a radial outflow of the compressor impeller. The field of application of the present invention also extends to compressors with a purely radial or diagonal inflow or outflow of the compressor impeller. The present invention furthermore relates to a diffuser for a radial compressor, wherein the radial compressor can be used in a turbocharger, and wherein the turbocharger can have an axial turbine or a radial turbine or what is known as a mixed flow turbine.

PRIOR ART

Diffusers for use in radial compressors for turbocharger applications are known from the prior art. In a radial compressor, a fluid, for example, air, is firstly sucked in axially via a compressor wheel connected upstream of the diffuser and accelerated and pre-compressed in the compressor wheel. Energy which is present in the form of pressure, temperature and kinetic energy is supplied to the fluid. High flow speeds prevail at the outlet of the compressor wheel. The accelerated and compressed air leaves the compressor wheel tangentially in the direction of the diffuser. Kinetic energy of the accelerated air is converted into pressure in the diffuser. This occurs by way of a deceleration of the flow in the diffuser. The flow cross-section of the diffuser is increased in size as a result of radial expansion. The fluid is thus decelerated and pressure is built up.

In order to achieve as high as possible pressure conditions in a turbocharger with a radial compressor, the diffusers used therein can be provided with a blading. DE 10 2008 044 505 shows an example of a bladed diffuser. The diffusers known from the prior art with blading are generally formed as radial parallel-walled diffusers with blading, such as shown, for example, in U.S. Pat. No. 4,131,389. In order to achieve a higher compressor efficiency at a given overall pressure ratio, the flow in the diffuser can be delayed to a greater extent. The flow speeds in the spiral are reduced as a result of this, as a result of which the wall friction losses are reduced and the efficiency of the compressor stage is improved.

It is known from the prior art that the use of diffusers with radial side wall divergence enables a greater deceleration with the same structural length in comparison with parallel-walled diffusers.

The deceleration or increase in pressure which can be achieved in the diffuser by geometrical variation for a given operating point is, however, restricted since flow instabilities arise in the case of excessive deceleration as a result of boundary layer detachment in the diffuser. The limits of the stable operating range of the diffuser thus determine the position of the surge limit of the compressor in the compressor characteristic diagram. If, instead of a parallel-walled diffuser, a diffuser with side wall divergence is used—such a diffuser is described, for example, in WO 2012/116880 A1—the efficiency is indeed increased in the case of the same compressor pressure ratios, but at the same time the surge limit for a given compressor pressure ratio is displaced in comparison with the compressor with a parallel-walled diffuser towards greater mass flows. This effect is undesirable. The compressor characteristic diagram width is reduced as a result of this and the usability of the compressor stage for applications in the turbocharger is restricted as a result of this.

One solution lies in fluidically connecting a diffuser channel portion of a bladed diffuser via pressure-equalizing openings to an annular channel in order to enable pressure equalization between individual diffuser passages of the diffuser which are formed by adjacent diffuser vanes. However, in the case of this solution using pressure-equalizing openings, the problem can arise that the annular channel and/or the individual pressure-equalizing openings block, for example, as a result of residues and deposits from compressor cleaning or by particles which are located in the oil-containing intake air. This has a negative influence on the surge limit of the compressor and can in extreme cases lead to it no longer being possible to operate a motor connected to the diffuser.

WO 2016/102594 discloses a diffuser for a radial compressor in the case of which the above-mentioned problem does not arise. This diffuser has a diffuser channel portion which is formed by a first side wall and a second side wall, wherein the first side wall and the second side wall are arranged at least partially divergently to one another in the direction of flow. The diffuser furthermore comprises a vane ring with a number of vanes, wherein the vanes are arranged at least partially in the diffuser channel portion, and wherein each of the vanes has a pressure side and a suction side. The pressure side and the suction side of each vane are delimited by a vane inlet edge and by a vane outlet edge of this vane. The diffuser furthermore comprises a number of pressure-equalizing openings which are incorporated in at least one of the two side walls of the diffuser channel portion, wherein each of the number of pressure-equalizing openings is arranged between the pressure side of a vane and the suction side of the adjacent vane of the vane ring. The diffuser furthermore comprises an annular channel which is arranged behind the pressure-equalizing openings, wherein the annular channel is fluidically connected to the diffuser channel portion via the pressure-equalizing openings. The annular channel can be connected via a connecting channel to a pressure plenum, as a result of which a fluid can flow from the pressure plenum into the annular channel so that the annular channel is rinsed with the fluid. Such a structure has the advantage that potential deposits and residues from carbonization by oil-containing intake air which could block the annular channel and the pressure-equalizing openings are rinsed out of the annular channel and thus also out of the pressure-equalizing openings by way of the fluid which is formed as a rinsing medium and which flows out of the pressure plenum into the annular channel in order to rinse out the annular channel with fluid.

SUMMARY OF THE INVENTION

The object on which the present invention is based is to further develop a bladed diffuser in such a manner that its operating range is increased.

This object is achieved by the diffuser with the features indicated in claim 1. Advantageous configurations and further development of the invention are indicated in the dependent claims.

A diffuser according to the invention has a flow channel which is delimited by a first side wall and a second side wall, a diffuser vane ring with a plurality of diffuser vanes which are arranged at least partially in the flow channel, wherein each of the diffuser vanes has a pressure side and a suction side, a plurality of diffuser passages, wherein these diffuser passages are formed between in each case two adjacent diffuser vanes of the plurality of diffuser vanes, and circulation openings, wherein each of these circulation openings connects the flow channel to a diffuser cavity and wherein at least two circulation openings are assigned to a diffuser passage, which circulation openings are fluidically connected to one another via the diffuser cavity.

The term diffuser passage refers to the region between two adjacent diffuser vanes which is determined on the inlet side by the vane inlet radius circle and on the outlet side by the vane outlet radius circle. A circulation opening assigned to a diffuser passage can be positioned within the diffuser passage, in front of the diffuser passage or behind the diffuser passage.

According to one embodiment of the present invention, the circulation openings assigned to a diffuser passage are arranged at different positions in the direction of flow.

According to one embodiment of the present invention, the circulation openings assigned to a diffuser passage are arranged next to one another in the direction of flow.

According to one embodiment of the present invention, in each case two or more circulation openings which are connected to one another via the diffuser cavity are assigned to all diffuser passages or only some of the diffuser passages.

According to one embodiment of the present invention, at least one circulation opening assigned to a diffuser passage is positioned upstream of the narrowest point of the diffuser passage and at least one further circulation opening assigned to the diffuser passage is positioned downstream of the narrowest point of the diffuser passage.

According to one embodiment of the present invention, the number of circulation openings positioned upstream of the narrowest point of the diffuser passage is greater than or equal to the number of circulation openings positioned downstream of the narrowest point of the diffuser passage.

According to one embodiment of the present invention, at least one of the circulation openings positioned upstream of the narrowest point of the diffuser passage is arranged within the diffuser passage between the pressure side of a diffuser vane and the suction side of an adjacent diffuser vane.

According to one embodiment of the present invention, at least one of the circulation openings positioned upstream of the narrowest point of the diffuser passage is positioned in front of the inlet of the diffuser passage in the direction of flow, wherein the inlet of the diffuser passage is determined by the vane inlet radius circle.

According to one embodiment of the present invention, at least one of the circulation openings positioned upstream of the narrowest point of the diffuser passage is positioned within the diffuser passage between the pressure side of a diffuser vane and the suction side of an adjacent diffuser vane and at least one further of the circulation openings positioned upstream of the narrowest point of the diffuser passage is positioned in front of the inlet of the diffuser passage in the direction of flow, wherein the inlet of the diffuser passage is determined by the vane inlet radius circle.

According to one embodiment of the present invention, at least one of the circulation openings positioned downstream of the narrowest point of the diffuser passage is arranged within the diffuser passage between the pressure side of a diffuser vane and the suction side of an adjacent diffuser vane.

According to one embodiment of the present invention, at least one of the circulation openings positioned downstream of the narrowest point of the diffuser passage is positioned behind the outlet of the diffuser passage, wherein the outlet of the diffuser passage is determined by the vane outlet radius circle.

According to one embodiment of the present invention, at least one of the circulation openings positioned downstream of the narrowest point of the diffuser passage is arranged within the diffuser passage between the pressure side of a diffuser vane and the suction side of an adjacent diffuser vane and at least one further of the circulation openings arranged downstream of the narrowest point of the diffuser passage is positioned behind the outlet of the diffuser passage, wherein the outlet of the diffuser passage is determined by the vane outlet radius circle.

According to one embodiment of the present invention, each diffuser passage which has circulation openings is assigned a separate diffuser cavity.

According to one embodiment of the present invention, several or all of the diffuser passages which have circulation openings are assigned a joint diffuser cavity.

According to one embodiment of the present invention, the joint diffuser cavity is an annular channel.

According to one embodiment of the present invention, one or more diffuser cavities are connected to a secondary fluid source.

According to one embodiment of the present invention, the circulation openings assigned to a diffuser passage are positioned in each case upstream of the narrowest point of the diffuser passage.

According to one embodiment of the present invention, a diffuser passage is assigned circulation openings with different cross-sectional surface areas and/or cross-sectional forms and/or orientations.

According to one embodiment of the present invention, the number and/or the arrangement and/or the cross-sectional surface areas of the circulation openings vary in the circumferential direction of the diffuser vane ring.

According to one embodiment of the present invention, a radial compressor is equipped with a diffuser according to the invention, a compressor wheel which is arranged upstream of the diffuser and has compressor wheel vanes and a spiral housing arranged downstream of the diffuser.

According to one embodiment of the present invention, a turbocharger is fitted with a radial compressor which has a diffuser according to the invention.

BRIEF DESCRIPTION OF THE DRAWINGS

The invention is described below on the basis of exemplary embodiments which are explained in greater detail on the basis of drawings. In the drawings.

Identical reference numbers are used for identical parts and parts with the same action in the following description.

DETAILED DESCRIPTION OF THE DRAWINGS

Figure 1:
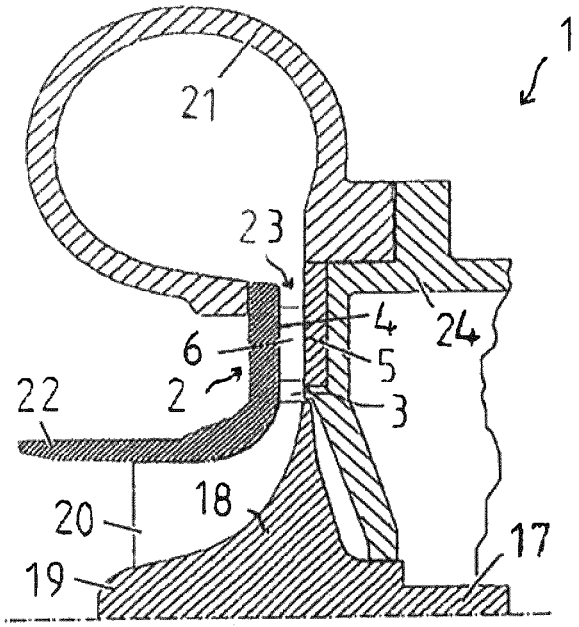
FIG. 1 shows a section along the compressor axis through a radial compressor which has a bladed diffuser.

FIG. 1 shows a section along the compressor axis through a radial compressor which has a bladed diffuser.

The represented radial compressor comprises a compressor wheel 18 which is arranged on a shaft 17 and which comprises a hub 19 and compressor wheel vanes 20 arranged on this hub. This compressor wheel is arranged in a compressor housing which generally comprises several components. These include a spiral housing 21 and an inlet housing 22. A bearing housing 24, in which shaft 17 is mounted, is located between the compressor and the turbine, not represented in FIG. 1. The flow channel of the compressor is delimited by the compressor housing. In the region of the compressor wheel, hub 19 of the compressor wheel takes on the radially inner delimitation, wherein compressor wheel vanes 20 are arranged in the flow channel.

Diffuser 2 which has a flow channel 3 and which serves to slow down the flow accelerated by the compressor wheel is arranged downstream of the compressor wheel in the direction of flow of the medium to be compressed. This is performed on one hand by diffuser vanes 6 of a diffuser vane ring, on the other hand by spiral housing 21 which has a spiral housing tongue in the transition region to flow channel 3 of diffuser 2. The compressed medium is supplied from the spiral housing to the combustion chambers of an internal combustion engine. Diffuser vanes 6 are connected on one side or both sides of flow channel 3 to a first side wall 4 or a second side wall 5.

Figure 2:
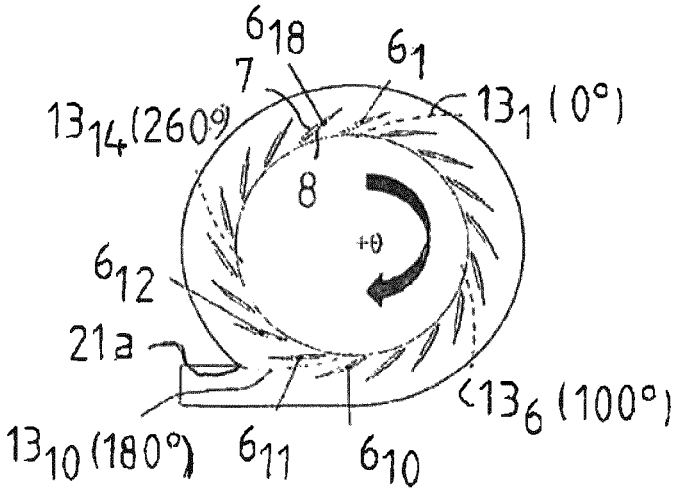
FIG. 2 shows a sketch to illustrate the distribution of the diffuser vanes along the entire circumferential region of a diffuser.

FIG. 2 shows a sketch to illustrate the distribution of the diffuser vanes along the entire circumferential region of the vane ring of a diffuser. It is apparent that, in the case of the exemplary embodiment shown, a total of 18 diffuser vanes $\mathbf{6}_1$ to $\mathbf{6}_{18}$ are provided along the entire circumferential region. In each case a diffuser passage is located between in each case two adjacent diffuser vanes. In the case of the exemplary embodiment shown, a total of 18 diffuser passages $\mathbf{13}_1, \ldots, \mathbf{13}_{18}$ are provided. The 18 diffuser vanes shown are spaced apart from one another along the entire circumferential region by in each case 20° and are consequently arranged equidistantly along the entire circumferential region. Each of the diffuser vanes has a pressure side 7 and a suction side 8, as is indicated in FIG. 2 in the case of diffuser vane $\mathbf{6}_{18}$. The center of diffuser passage $\mathbf{13}_1$ is located at 0°, the center of diffuser passage $\mathbf{13}_6$ at 100°, the center of diffuser passage $\mathbf{13}_{10}$ at 180° and the center of diffuser passage $\mathbf{13}_{14}$ at 260°. Spiral housing tongue 21*a* of spiral housing 21 arranged downstream of the diffuser is arranged in the immediate vicinity of diffuser passage $\mathbf{13}_{10}$.

Moreover, a pressure-equalizing opening, not represented in FIG. 2, is located between in each case two adjacent diffuser vanes in the case of known diffusers. This is provided between the suction side of a diffuser vane and the pressure side of the in each case adjacent diffuser vane.

The diffuser vanes shown in FIG. 2 all have the same profile and have in each case a vane inlet region and a vane outlet region.

Figure 3:
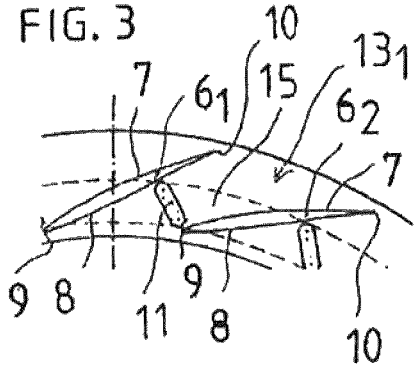
FIG. 3 shows a sketch to illustrate the arrangement of pressure-equalizing openings between two diffuser vanes of a known diffuser.

FIG. 3 shows a sketch to illustrate the arrangement of the pressure-equalizing openings between two adjacent diffuser vanes of a known diffuser. Diffuser vane $\mathbf{6}_1$ and adjacent diffuser vane $\mathbf{6}_2$ are represented in this sketch. Both diffuser vanes contain a pressure side 7 and a suction side 8. Both diffuser vanes furthermore contain a vane inlet edge 9 and a vane outlet edge 10. Pressure-equalizing opening 11 represented in FIG. 3 is formed to be slot-shaped and extends between suction side 8 of diffuser vane $\mathbf{6}_1$ and pressure side 7 of diffuser vane $\mathbf{6}_2$. Diffuser passage $\mathbf{13}_1$ extends between both diffuser vanes $\mathbf{6}_1$ and $\mathbf{6}_2$. Pressure-equalizing opening 11 is arranged in the region of the narrowest point of diffuser passage $\mathbf{13}_1$, wherein this narrowest point is also referred to as the throat. Pressure-equalizing opening 11 connects diffuser passage $\mathbf{13}_1$ fluidically to a diffuser cavity, arranged thereunder and shown by a dashed line, which diffuser cavity is an annular channel 15 in the case of the exemplary embodiment shown. This annular channel extends around the entire circumferential region of the diffuser vane ring and consequently connects diffuser passages $\mathbf{13}_1$ to $\mathbf{13}_{18}$ fluidically to one another via pressure-equalizing openings 11 of these diffuser passages.

One alternative embodiment lies in assigning each diffuser passage an individual diffuser cavity which is connected via a respective pressure-equalizing opening 11 to the respective diffuser passage.

Another alternative embodiment lies in not forming pressure-equalizing openings 11 in a slot-shaped manner, but rather to be circular.

In contrast to the embodiments described on the basis of FIG. 3, the diffuser passages of the diffuser according to the present invention are assigned in each case at least two circulation openings which are connected to one another via the diffuser cavity. The diffuser cavity can in turn be a joint diffuser cavity assigned to all the diffuser passages or only some of the diffuser passages, for example, an annular channel, or be a diffuser cavity assigned individually to the respective diffuser passage.

As a result of the positioning of the several circulation openings assigned to a diffusor passage, a connection of a position arranged downstream to a position arranged upstream, preferably a connection of a position arranged downstream of the narrowest point of the respective diffuser channel to a position arranged upstream of the narrowest point of the respective diffuser passage is performed via the diffuser cavity. As a result of such a positioning of the circulation openings assigned to a diffuser passage, it is achieved that a discharge of the supplied fluid into the diffuser cavity is performed by way of the circulation opening arranged in each case downstream and a return of fluid from the diffuser cavity into the diffuser passage is performed by way of the circulation opening arranged in each case upstream, which locally reduces the flow cross-section aerodynamically and influences the direction of flow and speed. If this arrangement is embodied on the shroud side, i.e. on the side of the diffuser facing away from the bearing housing, an aerodynamic expansion of the diffuser vane extending in the upstream direction can thus be achieved by corresponding positioning of the circulation openings. In the case of such a positioning of the circulation openings, an existing pressure difference is respectively used to drive a fluid mass flow through the diffuser cavity.

As a result of these measures, it is advantageously achieved that the mass flow rate conducted past the diffuser passage and the returned mass flow rate bring about automatic regulation according to a desired rotational speed characteristic curve of the compressor arranged upstream of the diffuser. This leads to a stabilization of the compressor operation. As a result of the return of the fluid, the surge limit of the compressor is advantageously displaced in the direction of lower fluid mass flow rates and, as a result of the discharge of the fluid, the choke limit of the compressor is displaced in the direction of higher fluid mass flow rates. This corresponds to an increase in size of the working range of the compressor. In this case, a deceleration or even a disappearance of the fluid flow can arise in the range between the surge limit and the choke limit, which has advantages in terms of the maximum efficiency which can be achieved.

In order to further increase the advantages described above of the invention, the number of circulation openings assigned to the respective diffuser passage can be increased. This increases in particular the stabilization effect of the described measures. This is in particular due to the fact that the measures described at least delay an occurrence of critical fluid flow situations on the shroud side and/or the stroke side of the diffuser and as a result expand the working range of the compressor.

The circulation openings of the diffuser passages can all have the same cross-sectional form and the same cross-sectional surface area. Alternatively to this, it is also possible that the circulation openings assigned to a diffuser passage have different cross-sectional forms and/or cross-sectional surface areas and/or different orientations.

These circulation openings and their relative positioning to one another must in any event be configured so that the fluid flow flowing through the circulation openings is sufficiently large in order to increase the working range of the diffuser in comparison with the working range of known diffusers.

For example, one embodiment lies in selecting the spacing of circulation openings spaced apart from one another in the direction of flow so that it is at least 25%, preferably at least 30% or at least 35% of the chord length of a diffuser vane.

Another embodiment lies in selecting the spacing of circulation openings adjacent to one another perpendicular to the direction of flow so that it is at least 25% of the spacing between two diffuser vanes adjacent to one another.

A further embodiment lies in the fact that, at at least one operating point, the percentage ratio of the mass flow which circulates through the circulation openings is greater than 1% of the entire mass flow.

Sketches to illustrate possible arrangements of the circulation openings assigned to a diffuser passage are explained in greater detail below on the basis of FIGS. 4 to 13.

Figure 4:
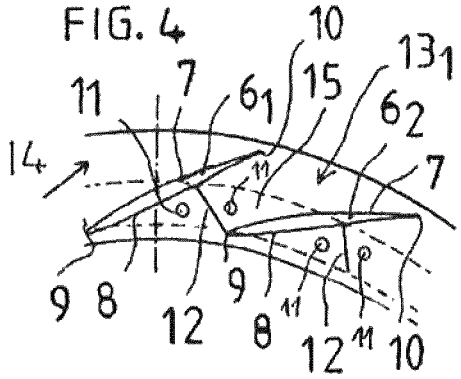
FIG. 4 shows a sketch to illustrate the arrangement of the circulation openings according to a first exemplary embodiment of the invention.

FIG. 4 shows a sketch to illustrate the circulation openings according to a first exemplary embodiment of the invention. Diffuser vane $\mathbf{6}_1$ and diffuser vane $\mathbf{6}_2$ adjacent thereto are represented in this sketch. Both diffuser vanes contain a pressure side 7 and a suction side 8. Both diffuser vanes furthermore contain a vane inlet edge 9 and a vane outlet edge 10. Diffuser passage $\mathbf{13}_1$ extends between both diffuser vanes $\mathbf{6}_1$ and $\mathbf{6}_2$. Two circulation openings 11 are provided within this diffuser passage, of which one is positioned upstream of narrowest point 12 of the diffuser passage and the other is positioned downstream of narrowest point 12 of the diffuser passage. The direction of flow is illustrated by arrow 14. Both circulation openings 11 are arranged between suction side 8 of diffuser vane $\mathbf{6}_1$ and pressure side 7 of diffuser vane $\mathbf{6}_2$.

Both circulation openings 11 are fluidically connected to one another by a diffuser cavity formed as an annular channel and common to all the diffuser passages. This annular channel extends around the entire circumferential region of the diffuser vane ring and consequently connects diffuser passages $\mathbf{13}_1$ to $\mathbf{13}_{18}$ fluidically to one another via circulation openings 11 of these diffuser passages.

Figure 5:
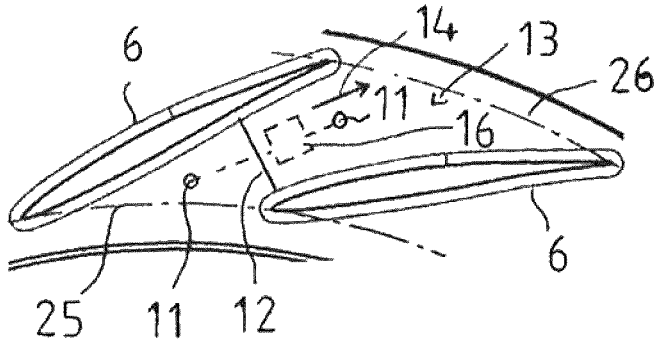
FIG. 5 shows a sketch to illustrate the arrangement of the circulation openings according to a second exemplary embodiment of the invention.

FIG. 5 shows a sketch to illustrate the circulation openings according to a second exemplary embodiment of the invention. This second exemplary embodiment differs from the first exemplary embodiment shown in FIG. 4 in that each diffuser passage is assigned an individual diffuser cavity 16 shown by a dashed line in FIG. 5 which is fluidically connected to the diffuser passage via both circulation openings 11 assigned to this diffuser passage. Also in the case of this second exemplary embodiment, the two circulation openings 11 assigned to the diffuser passage are arranged at different positions in the direction of flow, wherein one circulation opening is arranged downstream of the narrowest point of the diffuser passage and the other circulation opening is arranged upstream of the narrowest point of the diffuser passage. Both circulation openings 11 are in turn arranged in the region between two adjacent diffuser vanes and indeed between the vane inlet region, which is determined by vane inlet radius circle 25, and the vane outlet region, which is determined by vane outlet radius circle 26.

Figure 6:
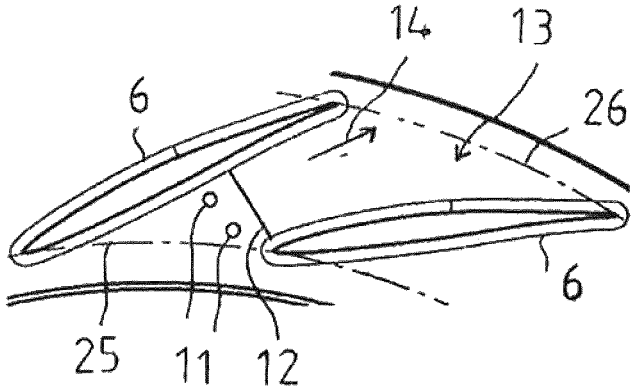
FIG. 6 shows a sketch to illustrate the arrangement of the circulation openings according to a third exemplary embodiment of the invention.

FIG. 6 shows a sketch to illustrate the circulation openings according to a third exemplary embodiment of the invention. In the case of this third exemplary embodiment, two circulation openings 11 arranged next to one another in the direction of flow are provided upstream of narrowest point 12 of the diffuser passage, while no circulation opening 11 is provided downstream of narrowest point 12 of the diffuser passage. These circulation openings 11 are in turn fluidically connected to one another by a diffuser cavity, not shown in FIG. 6. Circulation openings 11 are, also in the case of this exemplary embodiment, arranged in the region between two adjacent diffuser vanes and indeed between the vane inlet region, which is determined by vane inlet radius circle 25, and the vane outlet region, which is determined by vane outlet radius circle 26.

Figure 7:
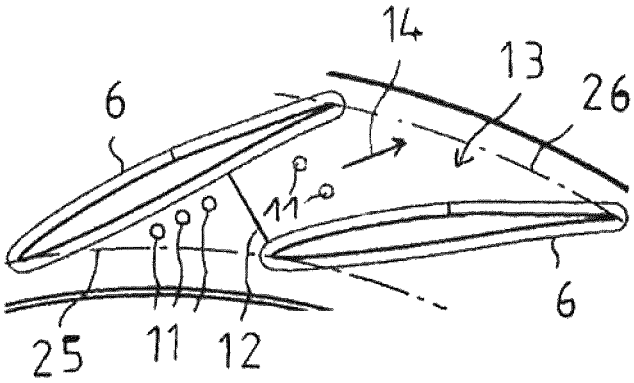
FIG. 7 shows a sketch to illustrate the arrangement of the circulation openings according to a fourth exemplary embodiment of the invention.

FIG. 7 shows a sketch to illustrate the circulation openings according to a fourth exemplary embodiment of the invention. In the case of this fourth exemplary embodiment, three circulation openings 11 are provided upstream of narrowest point 12 of the diffuser passage, while two circulation openings 11 are provided downstream of narrowest point 12 of the diffuser passage. These in total five circulation openings 11 are in turn fluidically connected to one another by a diffuser cavity, not shown in FIG. 7. All five circulation openings 11 are in turn arranged in the region between two adjacent diffuser vanes and indeed between the vane inlet region, which is determined by vane inlet radius circle 25, and the vane outlet region, which is determined by vane outlet radius circle 26.

Figure 8:
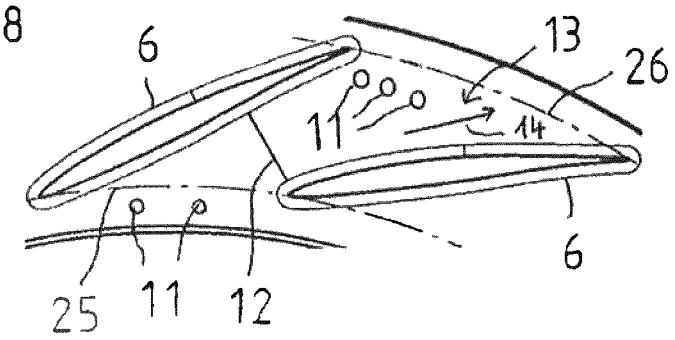
FIG. 8 shows a sketch to illustrate the arrangement of the circulation openings according to a fifth exemplary embodiment of the invention.

FIG. 8 shows a sketch to illustrate the circulation openings according to a fifth exemplary embodiment of the invention. In the case of this fifth exemplary embodiment, two circulation openings 11 are provided upstream of narrowest point 12 of the diffuser passage, while three circulation openings 11 are provided downstream of narrowest point 12 of the diffuser passage. These in total five circulation openings 11 are in turn fluidically connected to one another by a diffuser cavity, not shown in FIG. 8. The two circulation openings 11 arranged upstream of the narrowest point of the diffuser passage are, in the case of this exemplary embodiment, positioned in front of the inlet of the diffuser passage in the direction of flow, wherein this inlet is determined by vane inlet radius circle 25. The three circulation openings 11 arranged downstream of narrowest point 12 of the diffuser passage are arranged in the region between two adjacent diffuser vanes and indeed between narrowest point 12 of the diffuser passage and the vane outlet region, which is determined by vane outlet radius circle 26.

Figure 9:
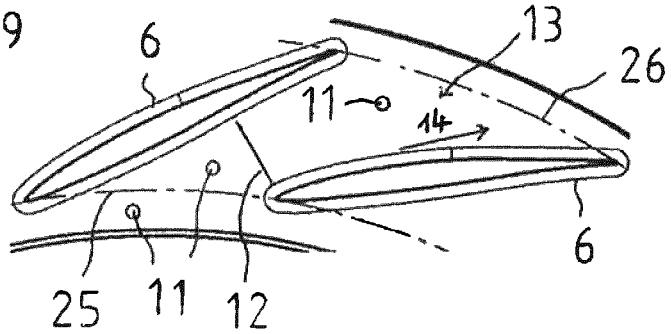
FIG. 9 shows a sketch to illustrate the arrangement of the circulation openings according to a sixth exemplary embodiment of the invention.

FIG. 9 shows a sketch to illustrate the circulation openings according to a sixth exemplary embodiment of the invention. In the case of this sixth exemplary embodiment, two circulation openings 11 are provided upstream of narrowest point 12 of the diffuser passage, while only one circulation opening 11 is provided downstream of narrowest point 12 of the diffuser passage. These in total three circulation openings 11 are in turn fluidically connected to one another by a diffuser cavity, not shown in FIG. 9. Of the two circulation openings 11 arranged upstream of narrowest point 12 of the diffuser passage, in the case of this exemplary embodiment, one circulation opening is arranged in front of the inlet of the diffuser passage in the direction of flow, wherein this inlet is determined by vane inlet radius circle 25, and the other circulation opening in the region between the two adjacent diffuser vanes between the vane inlet region and narrowest point 12 of the diffuser passage. Circulation opening 11 arranged downstream of narrowest point 12 of the diffuser passage is arranged in the region between two adjacent diffuser blades and indeed between narrowest point 12 of the diffuser passage and the vane outlet region, which is determined by vane outlet radius circle 26.

Figure 10:
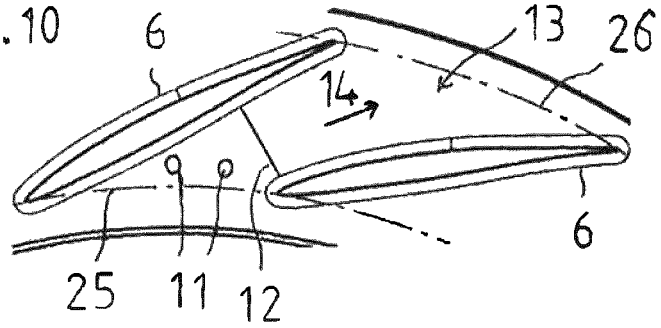
FIG. 10 shows a sketch to illustrate the arrangement of the circulation openings according to a seventh exemplary embodiment of the invention.

FIG. 10 shows a sketch to illustrate the circulation openings according to a seventh exemplary embodiment of the invention. In the case of this seventh exemplary embodiment, two circulation openings 11 are provided upstream of narrowest point 12 of the diffuser passage, while no circulation opening is provided downstream of narrowest point 12 of the diffuser passage. These two circulation openings 11 are in turn fluidically connected to one another by a diffuser cavity, not shown in FIG. 11. Both circulation openings 11 arranged upstream of narrowest point 12 of the diffuser passage are, in the case of this exemplary embodiment, positioned in the region between two adjacent diffusor vanes, and indeed between the vane inlet region, which is determined by vane inlet radius circle 25, and narrowest point 12 of the diffuser passage.

Figure 11:
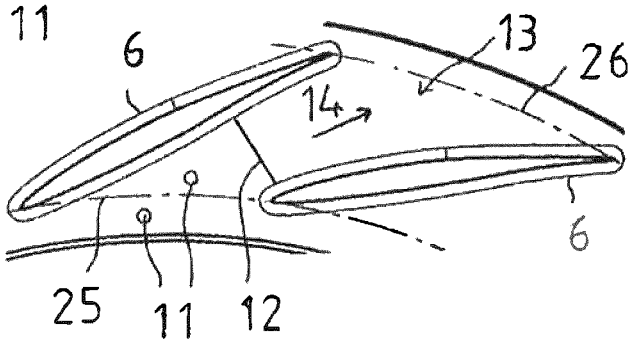
FIG. 11 shows a sketch to illustrate the arrangement of the circulation openings according to an eighth exemplary embodiment of the invention.

FIG. 11 shows a sketch to illustrate the circulation openings according to an eighth exemplary embodiment of the invention. In the case of this eighth exemplary embodiment, two circulation openings 11 are provided upstream of narrowest point 12 of the diffuser passage, while no circulation opening is provided downstream of narrowest point 12 of the diffuser passage. These two circulation openings 11 are in turn fluidically connected to one another by a diffuser cavity, not shown in FIG. 11. Of the two circulation openings 11 arranged upstream of narrowest point of the diffuser passage, in the case of this exemplary embodiment, one circulation opening is positioned in front of the inlet of the diffuser passage in the direction of flow, wherein this inlet is determined by vane inlet radius circle 25, and the other pressure-equalizing opening in the region between two adjacent diffuser vanes, and indeed between the vane inlet region, which is determined by vane inlet radius circle 25, and narrowest point 12 of the diffuser passage.

Figure 12:
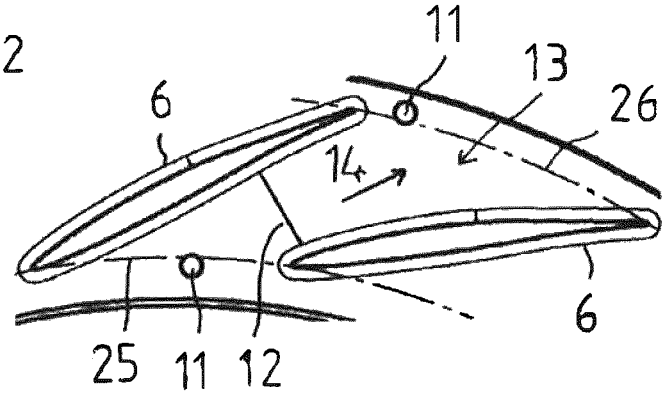
FIG. 12 shows a sketch to illustrate the arrangement of the circulation openings according to a ninth exemplary embodiment of the invention and FIG. 13 shows a sketch to illustrate the arrangement of the circulation openings according to a tenth exemplary embodiment of the invention.

FIG. 12 shows a sketch to illustrate the circulation openings according to a ninth exemplary embodiment of the invention. In the case of this ninth exemplary embodiment, one circulation opening 11 is provided upstream of narrowest point 12 of diffuser passage 13. One circulation opening 11 is likewise provided downstream of narrowest point 12 of diffuser passage 13. Circulation opening 11 arranged upstream of narrowest point 12 of diffuser passage 13 is arranged in front of the inlet of diffuser passage 13 in direction of flow 14, which inlet is determined by vane radius inlet circle 25. Circulation opening 11 arranged downstream of narrowest point 12 of diffuser passage 13 is arranged behind the outlet of diffuser passage 13 in direction of flow 14, which outlet is determined by vane outlet radius circle 26.

Figure 13:
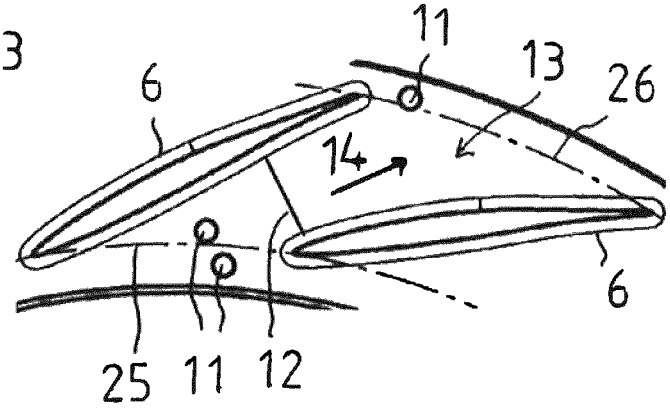

FIG. 13 shows a sketch to illustrate the circulation openings according to a tenth exemplary embodiment of the invention. In the case of this tenth exemplary embodiment, two circulation openings 11 are provided upstream of narrowest point 12 of diffuser passage 13. One circulation opening 11 is provided downstream of narrowest point 12 of diffuser passage 13. One of the two circulation openings 11 arranged upstream of narrowest point 12 of diffuser passage 13 is arranged in front of the inlet of diffuser passage 13 in direction of flow 14, which inlet is determined by vane radius inlet circle 25. The other of the two circulation openings 11 arranged upstream of narrowest point 12 of diffuser passage 13 is arranged in diffuser passage 13 between the two diffuser vanes 6. Circulation opening 11 arranged downstream of narrowest point 12 of diffuser passage 13 is arranged behind the outlet of diffuser passage 13 in direction of flow 14, which outlet is determined by vane outlet radius circle 26.

An advantageous further development of the invention which can be used in all the exemplary embodiments described above lies in connecting a joint diffuser cavity formed as an annular channel to a secondary fluid source. The fluid provided by this secondary fluid source can be used to rinse the annular channel with the fluid where necessary. As a result, potential deposits and residues from carbonization by oil-containing intake air which could block the annular channel and the circulation openings can be rinsed out of the annular channel and thus also out of the circulation openings.

One alternative embodiment of the invention lies in only assigning certain diffuser passages with circulation openings, for example, those diffuser passages which are arranged in a circumferential region of the diffuser vane ring, in the vicinity of which instabilities can arise during operation, for example, in the vicinity of a spiral tongue-side outlet of the flow channel of the diffuser.

One advantageous embodiment of the invention lies in providing the diffuser cavity/cavities and the circulation openings in the shroud-side side wall of the diffuser.

A further advantageous embodiment of the invention lies in embodying the side walls of the diffuser to be divergent at least in portions.

A further advantageous embodiment of the invention lies in using diffuser vanes with different profiles.

A further advantageous embodiment of the invention lies in varying the input angles of the diffuser passages by rotating diffuser vanes.

A further embodiment of the invention lies in assigning each diffuser passage which has circulation openings a separate diffuser cavity. This diffuser cavity can be a simple connecting line.

A further embodiment lies in fluidically connecting a circulation opening assigned to a diffuser passage to a circulation opening assigned to a different diffuser passage, preferably to a circulation opening assigned to an adjacent diffuser passage, via the diffuser cavity, for example, a circulation opening arranged upstream of the narrowest point of a diffuser passage to a circulation opening assigned to a directly adjacent diffuser passage downstream of the narrowest point.

LIST OF REFERENCE NUMBERS

1 Radial compressor
2 Diffuser
3 Flow channel
4 First side wall of the diffuser
5 Second side wall of the diffuser
6 Diffuser vane
$\mathbf{6}_1, \ldots, \mathbf{6}_{18}$ Diffuser vanes
7 Pressure side of the diffuser vane
8 Suction side of the diffuser vane
9 Vane inlet edge
10 Vane outlet edge
11 Circulation opening
12 Throat; narrowest point of a diffuser passage
13 Diffuser passage
$\mathbf{13}_1, \ldots, \mathbf{13}_{18}$ Diffuser passages
14 Direction of flow
15 Joint diffuser cavity; annular channel
16 Individual diffuser cavity
17 Shaft
18 Compressor wheel
19 Hub
20 Compressor wheel vane
21 Spiral housing
21*a* Spiral housing tongue
22 Inlet housing
23 Spiral housing-side outlet of the diffuser channel
24 Bearing housing
25 Vane inlet radius circle
26 Vane outlet radius circle

The invention claimed is:

1. A diffuser for a radial compressor of a turbocharger, the diffuser comprising:

a flow channel which is delimited by a first side wall and a second side wall, a diffuser vane ring with a plurality of diffuser vanes arranged at least partially in the flow channel, wherein each of the diffuser vanes has a pressure side and a suction side, a plurality of diffuser passages, wherein each of the plurality of diffuser passages is formed between two adjacent diffuser vanes of the plurality of diffuser vanes, and circulation openings, wherein each of the circulation openings connects the flow channel to a diffuser cavity, wherein at least two circulation openings are assigned to a diffuser passage, wherein a circulation opening assigned to a diffuser passage is fluidically connected to a further circulation opening assigned to the same diffuser passage or to a circulation opening assigned to another diffuser passage via the diffuser cavity, wherein the at least two circulation openings assigned to a diffuser passage are arranged at different positions in the direction of flow such that a downstream circulation opening discharges fluid supplied into the diffuser cavity and an upstream circulation opening returns fluid from the diffuser cavity into the diffuser passage, and wherein at least one of the circulation openings assigned to a diffuser passage is positioned upstream of the narrowest point of the diffuser passage.

2. The diffuser of claim 1, wherein two or more circulation openings which are connected to one another via the diffuser cavity are assigned to at least some of the diffuser passages.

3. The diffuser of claim 1, wherein at least one further of the circulation openings assigned to the diffuser passage is positioned downstream of the narrowest point of the diffuser passage.

4. The diffuser of claim 3, wherein the number of circulation openings positioned upstream of the narrowest point of the diffuser passage is greater than or equal to the number of circulation openings positioned downstream of the narrowest point of the diffuser passage.

5. The diffuser of claim 1, wherein at least one of the circulation openings positioned upstream of the narrowest point of the diffuser passage is arranged within the diffuser passage between the pressure side of a diffuser vane and the suction side of an adjacent diffuser vane.

6. The diffuser of claim 1, wherein at least one of the circulation openings positioned upstream of the narrowest point of the diffuser passage is positioned in front of the inlet of the diffuser passage in the direction of flow, wherein the inlet of the diffuser passage is determined by the vane inlet radius circle.

7. The diffuser of claim 1, wherein at least one of the circulation openings positioned upstream of the narrowest point of the diffuser passage is positioned within the diffuser passage between the pressure side of a diffuser vane and the suction side of an adjacent diffuser vane and at least one further of the circulation openings positioned upstream of the narrowest point of the diffuser passage is positioned in front of the inlet of the diffuser passage in the direction of flow, wherein the inlet of the diffuser passage is determined by the vane inlet radius circle.

8. The diffuser of claim 3, wherein at least one of the circulation openings positioned downstream of the narrowest point of the diffuser passage is arranged within the diffuser passage between the pressure side of a diffuser vane and the suction side of an adjacent diffuser vane.

9. The diffuser of claim 3, wherein at least one of the circulation openings positioned downstream of the narrowest point of the diffuser passage is positioned behind the outlet of the diffuser passage, wherein the outlet of the diffuser passage is determined by the vane outlet radius circle.

10. The diffuser of claim 3, wherein at least one of the circulation openings arranged downstream of the narrowest point of the diffuser passage is positioned within the diffuser passage between the pressure side of a diffuser vane and the suction side of an adjacent diffuser vane and at least one further of the circulation openings arranged downstream of the narrowest point of the diffuser passage is positioned behind the outlet of the diffuser passage, wherein the outlet of the diffuser passage is determined by the vane outlet radius circle.

11. The diffuser of claim 1, wherein each diffuser passage which has circulation openings is assigned a separate diffuser cavity.

12. The diffuser of claim 1, wherein several or all of the diffuser passages which have circulation openings are assigned a joint diffuser cavity.

13. The diffuser as claimed in claim 12, characterized in that the joint diffuser cavity is an annular channel.

14. The diffuser of claim 13, wherein one or more diffuser cavities are connected to a secondary fluid source.

15. The diffuser of claim 2, wherein the circulation openings assigned to a diffuser passage are positioned in each case upstream of the narrowest point of the diffuser passage.

16. The diffuser of claim 1, wherein a diffuser passage is assigned circulation openings with different cross-sectional surface areas and/or cross-sectional forms and/or orientations.

17. The diffuser of claim 1, wherein the number and/or the arrangement and/or the cross-sectional surface areas of the circulation openings vary in the circumferential direction of the diffuser vane ring.

18. A radial compressor comprising:

the diffuser of claim 1, a compressor wheel which is arranged upstream of the diffuser and has compressor wheel vanes, and a spiral housing arranged downstream of the diffuser.

19. A turbocharger comprising:

the radial compressor of claim 18.

20. The diffuser of claim 12, wherein one or more diffuser cavities are connected to a secondary fluid source.

21. The diffuser of claim 1, wherein the diffuser cavity and the circulation openings are provided on a shroud-side wall of the diffuser.

22. The diffuser of claim 1, wherein the diffuser vanes have different profiles.

23. The diffuser of claim 1, wherein the input angles of the diffuser passages are varied.

* * * * *